US005386997A

United States Patent [19]

Smith

[11] Patent Number: 5,386,997

[45] Date of Patent: Feb. 7, 1995

[54] PORTABLE GOLF PRACTICE APPARATUS

[76] Inventor: George C. Smith, 1738 Edeline Ave., McKinleysville, Calif. 95521

[21] Appl. No.: 120,398

[22] Filed: Sep. 13, 1993

[51] Int. Cl.[6] ..... A63B 69/36

[52] U.S. Cl. ..... 273/198; 273/181 R; 273/185 C; 273/186.4; 273/200 R

[58] Field of Search ..... 273/181 R, 182 R, 181 B, 273/181 J, 181 R, 35 R, 183.1, 185 C, 185 D, 184 B, 186.4, 195, 196, 197 R, 197 A, 198, 200 R, 200 A, 200 B

[56] References Cited

U.S. PATENT DOCUMENTS

| | | | |
|---|---|---|---|
| 914,873 | 3/1909 | Peter . | |
| 1,210,970 | 1/1917 | Nott . | |
| 1,677,557 | 7/1928 | Johnson . | |
| 1,967,076 | 7/1934 | Bickerton | 273/198 |
| 2,034,684 | 3/1936 | Wagner . | |
| 2,230,282 | 2/1941 | Bickerton | 273/198 |
| 2,236,500 | 4/1941 | Gillette | 273/198 |
| 2,469,002 | 5/1949 | Quattrin | 273/198 |
| 2,656,720 | 10/1953 | Sonnett | 273/196 |
| 2,695,175 | 11/1954 | Trapp . | |
| 3,124,958 | 3/1964 | McDonnell . | |
| 3,430,493 | 3/1969 | Wall . | |
| 3,494,621 | 2/1970 | Windall . | |
| 3,830,504 | 8/1974 | Koo . | |
| 3,870,314 | 3/1975 | Bertucci | 273/185 D |
| 4,084,822 | 4/1978 | Keeton . | |
| 4,119,318 | 10/1978 | de Kremer et al. . | |
| 4,139,197 | 2/1979 | Windall | 273/185 C |
| 4,915,388 | 4/1990 | Serin . | |
| 4,986,551 | 1/1991 | Langlois et al. . | |
| 5,156,400 | 10/1992 | Nemeth . | |

*Primary Examiner*—Mark S. Graham
*Attorney, Agent, or Firm*—Nixon & Vanderhye

[57] ABSTRACT

A golf practice apparatus includes an upper platform having a tee and a target located forwardly of the tee; a golf ball arranged at the tee above the platform for striking towards the target area, the golf ball having one end of a tether attached thereto, the tether extending through a slot in the upper platform with the other end of the tether being secured to elastic bands anchored to a lower platform at a location rearwardly of the tee area; and a plurality of bearings located in the tee area and supported on the lower platform, and arranged so that the tether engages at least two of the plurality of bearings. The tether has a sleeve attached thereto which is adapted to engage the lower surface of the upper platform, and thereby generate friction between the upper platform and the sleeve when the ball is struck. The combination of a plurality of bearings and a friction sleeve provides significant braking forces to slow down the flight of the ball, and to control return of the ball for a subsequent shot. The apparatus also provides for various adjustments to permit simulation of various golf shots and various lies of the ball.

34 Claims, 3 Drawing Sheets

PORTABLE GOLF PRACTICE APPARATUS

BACKGROUND AND SUMMARY OF THE INVENTION

This invention relates to a portable, compact golf practice device which is simple and easy to use, and which incorporates numerous advantageous features which allow the user to practice difference golf shots under a variety of simulated conditions.

There are numerous examples of golf practice devices in the patent literature, exhibiting varying degrees of complexity and incorporating equally varying capabilities. Some disclose devices with tethered golf balls with no particular mechanism for automatically returning the ball to a position ready for the next hit (see, for example, U.S. Pat. Nos. 914,873; 1,210,970; and 2,034,684. Some prior patents disclose golf practice devices where some degree of ball control is provided (see, for example, U.S. Pat. Nos. 3,430,493; 3,494,621; and 4,119,318). Still other devices include arrangements where the ball is held substantially in place (see, for example, U.S. Pat. Nos. 3,830,504 and 4,084,822). Other representative examples of golf practice devices may be found in U.S. Pat. Nos. 1,677,557; 2,695,175; 3,124,958; 4,915,388; 4,986,551; and 5,156,400.

It is the object of this invention to provide a simple, easy to use and low cost practice device which allows the user to practice golf shots with a variety of clubs; allows the user to simulate various lies (level, uphill, downhill, partially buried), and indicates to the user the lateral flight of the ball, i.e., whether the shot hooked, sliced, or flew straight. To this end, I have developed a golf practice device which includes a pair of platforms which are designed to partially overlie each other during use, the lower of the platforms containing golf ball tether, ball flight braking means and ball return means, and the upper of the platforms simulating the tee area and supporting a target. More specifically, the lower platform supports along one longitudinal side edge thereof, a U-shaped channel in which the ball tether and associated elastic bands are supported, along with a plurality of rotatable bearings through which the tether is "threaded" and which serve as ball flight braking means. The tether, upon exiting the bearing arrangement, extends upwardly through (and adjacent the rearward end of) an elongated slot in the upper platform. The forward end of the tether extends through the golf ball and is secured by a knot. A flexible sleeve of an inch or two in length is loosely located on the tether, between the ball and the slot, and serves as a tee. The rearward end of the tether is coupled to one or more elastic bands which, in turn, are secured at the rearward end of the channel.

A target is located downstream of the slot, and approximately eighteen inches from the tee, i.e., the ball flies no more than about eighteen inches when struck. Targets in accordance with this invention permit the user to determine whether the shot hooked, sliced, or flew straight. In one exemplary embodiment, a flexible, foam backed rubber target (preferably black in color) is provided with vertical lines from a center point. At the same time, chalk or other indicator material can be applied to the ball so that a mark is left on the target when struck. The mark can then be examined relative to the center line of the target.

A foot pad is also provided which extends substantially perpendicularly to the upper and lower platforms and it is from this pad that the user addresses the ball. Upon striking the ball, the latter will fly to the target, expanding the elastic bands connected to the tether. At the same time, the bearings through which the tether is threaded apply a braking force on the flight of the ball, which also tends to bring the ball down so that it will strike the target. Additional braking action may be obtained by utilization of a grommet or sleeve on the tether adjacent the coupling to the elastic bands. It has been found that the frictional engagement of this sleeve or grommet with the underside of the upper platform as the ball flies toward the target, contributes significant additional braking action on the flight of the ball.

It will be appreciated, of course, that the bearing arrangement in combination (or not) with the sleeve or grommet, achieve a controlled return of the ball (under the influence of the elastic bands) to the tee position. As will be explained in greater detail further below, the manner in which the tether is threaded through the bearings may be altered to change the braking characteristics of the bearings, and these adjustments can be made in accordance with the type of shots, i.e., light, medium, hard, etc. to be hit.

It is also a feature in this invention that the tension in the elastic bands can be adjusted, and this allows the user to control the ball return so as to facilitate the next shot. In other words, by increasing the elastic band tension, the ball will return to a position where it sits atop the tee for a subsequent "tee shot". Reducing the elastic band tension creates a condition where the ball is off the tee (i.e., to the rear of the tee, with the tee "lying down") to thereby facilitate a subsequent "ground shot".

Various other adjustments can be made to facilitate shots with different clubs, shots by light or heavy hitters, and shots at various lies (level, uphill, downhill and even partially buried). For example, the front end of the upper platform can be raised (along with the target) to simulate an uphill lie, but also to insure that high are shots (with a seven or nine iron, for example) will strike the target. The front end of the lower platform can also be lowered to simulate a downhill lie, and a separate pad can be arranged behind the ball to simulate a partially buried lie. In addition, the number of elastic bands can be changed depending on the hitting style of the user. For "heavy" hitters, three or four bands may be used while, for "light" hitters, the two bands may suffice. The various adjustments to the apparatus are described in detail further hereinbelow.

In its broadest aspect, the present invention relates to a golf practice apparatus comprising at least one platform having a tee area and a target area located forwardly of the tee area; a golf ball arranged at the area above the platform for striking towards the target area, the golf ball having one end of a tether attached thereto, the tether extending through a slot in the platform, with the other end of the tether being secured to elastic bands anchored at a location rearwardly of the tee area; and a plurality of rotatable, axially spaced bearings located in the tee area below said platform, and arranged so that the tether engages at least two of the plurality of bearings.

In another aspect, the invention relates to a golf practice apparatus comprising at least one platform having a tee area and a target area located forwardly of the tee area; a golf ball arranged at the area above the platform for striking towards the target area, the golf ball having one end of a tether attached thereto, the tether extending through a slot in the platform, with the other end of the tether being secured to elastic means anchored below the platform at a location rearwardly of the tee area; the tether having a sleeve attached thereto which is adapted to engage the lower surface of the platform, and thereby generate friction between the platform and said sleeve when the ball is struck.

In still another aspect, the invention relates to a golf practice apparatus comprising an upper platform having a tee and a target located forwardly of the tee; a golf ball arranged at the tee above the platform for striking towards the target area, the golf ball having one end of a tether attached thereto, the tether extending through a slot in the upper platform, with the other end of the tether being secured to elastic bands anchored to a lower platform at a location rearwardly of the tee area; and a plurality of bearings located in the tee area and supported on the lower platform, and arranged so that the tether engages at least two of the plurality of bearings; the tether having a sleeve attached thereto which is adapted to engage the lower surface of the upper platform, and thereby generate friction between the upper platform and the sleeve when the ball is struck.

These and other features and advantages of the invention will become apparent in connection with the detailed description provided below.

DETAILED DESCRIPTION OF THE DRAWINGS

Figure 1:
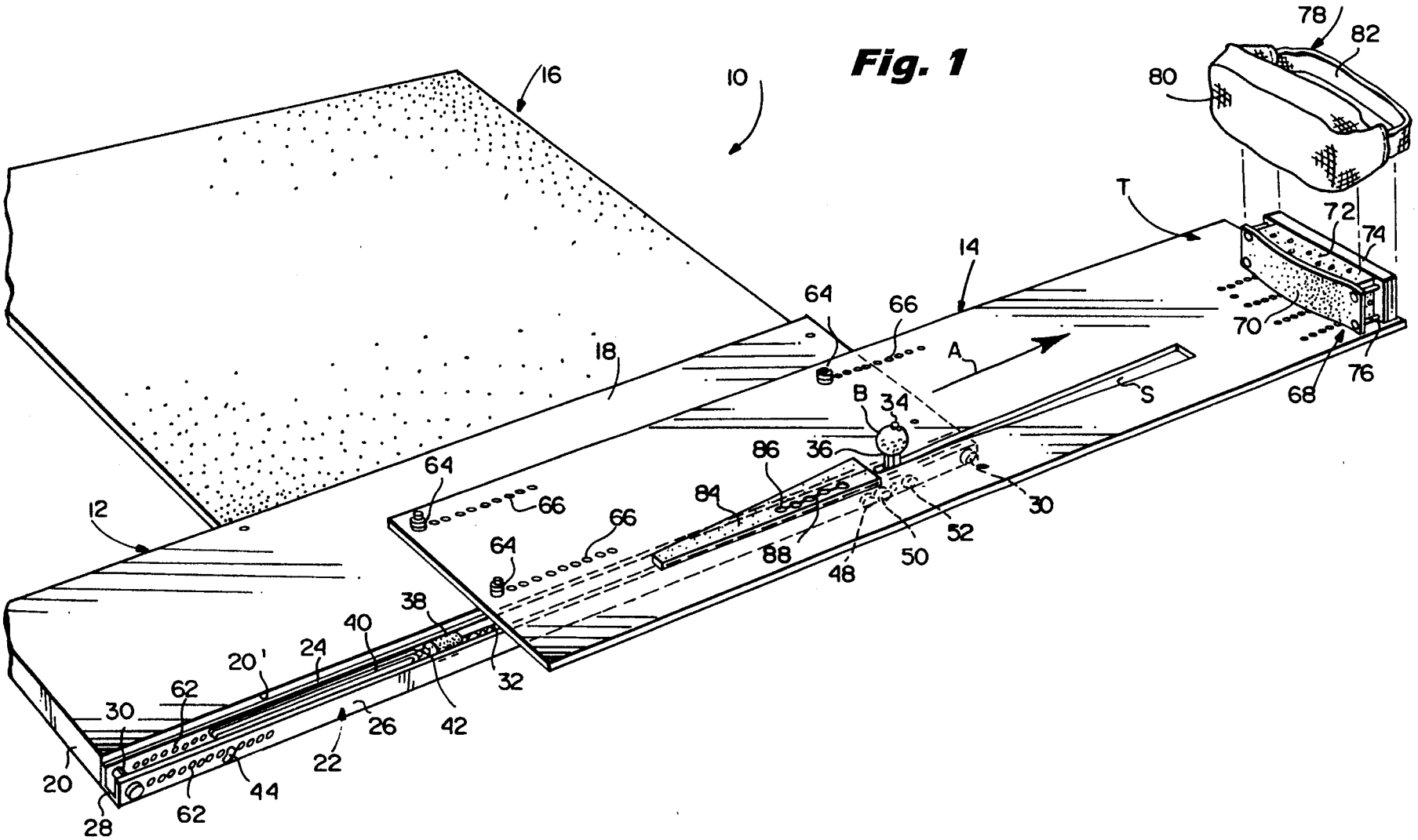
FIG. 1 is a perspective view of a portable practice golf apparatus in accordance with an exemplary embodiment of the invention.

With reference to FIG. 1, the portable golf practice apparatus 10 in accordance with this invention includes, generally, a lower platform 12, an upper platform 14, and a foot mat 16 extending at right angles to the platforms 12 and 14. The foot mat 16 is connected to the lower platform 12 by suitable fasteners. In the exemplary embodiment, the lower platform 12 may be constructed of wood or other suitable material. The upper platform 14 is preferably constructed of high impact—high density polyethylene sheeting, although other suitable materials may be employed. The foot mat 16 may be of any conventional mat material, such as rubber, vinyl, artificial turf or the like. Before a further detailed discussion is provided with respect to the apparatus shown in FIG. 1, and in order to facilitate an overall understanding of the device, it should be appreciated that the user will stand on the mat 16 and address the golf ball B with the golf club head resting on the upper platform 14 behind the ball B. Thus, the ball will be struck towards a target area T at that end of the platform 14 which is remote from the lower platform 12, the flight of the ball being indicated by arrow A.

Figure 2:
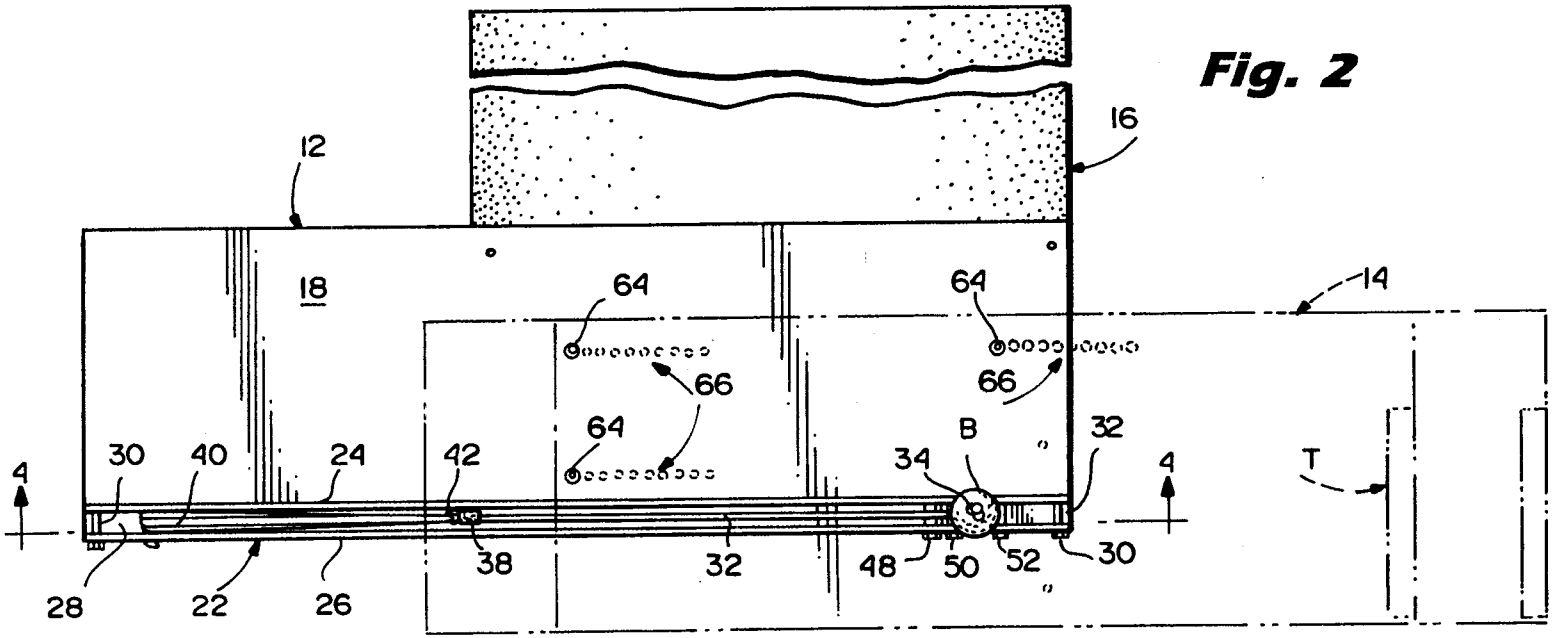
FIG. 2 is a plan view of the apparatus illustrated in FIG. 1, with a portion thereof shown in phantom for ease of understanding.
Figure 3:
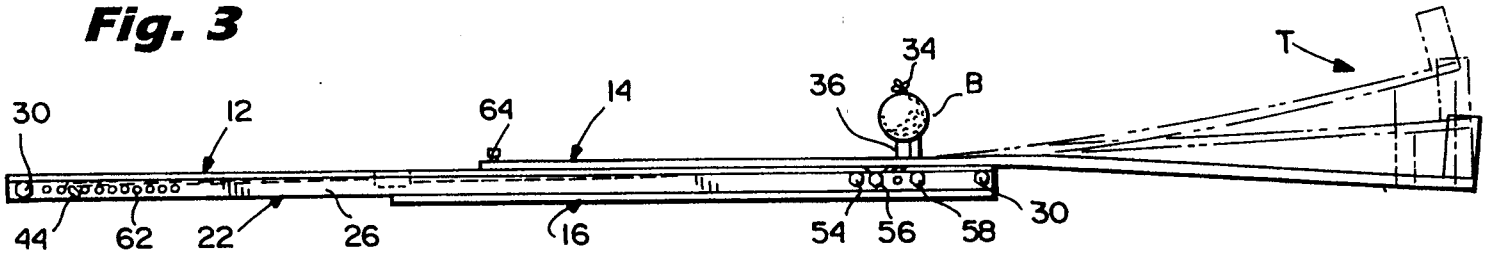
FIG. 3 is a side view of the apparatus shown in FIG. 1, and showing in phantom a range of adjustment for a target portion of the apparatus.
Figure 4:
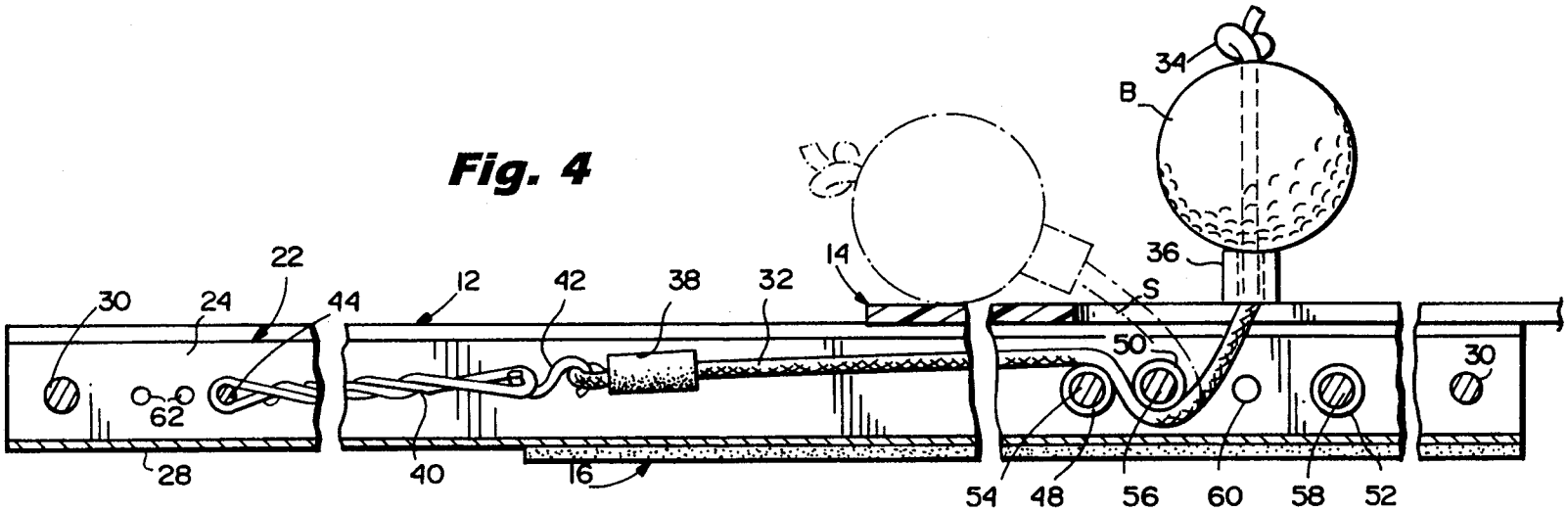
FIG. 4 is a partial side section of the apparatus shown in FIGS. 1–3.

With reference also to FIGS. 2, 3 and 4, the lower platform 12 includes an upper surface 18 bounded by a peripheral edge 20. The platform 12 is preferably of an elongated, rectangular shape, and along a lengthwise edge portion 20∝ (FIG. 1) of the peripheral edge 20, opposite the foot mat 16, there is secured a U-shaped channel 22 which includes vertical side walls 24, 26, and a lower connector wall or web 28. The channel 22 is secured to the edge 20' by means of suitable fasteners 30 located at opposite ends of the channel. It will be appreciated that the height of the side walls 24, 26 is no greater than the thickness of the lower platform 12, so that the upper edges of the side walls 24, 26 do not protrude above the upper surface 18 of the lower platform 12.

As best seen in FIGS. 2 and 4, the channel 22 partially encloses a tether 32 which, at one end, passes through the ball B and is knotted as at 34 to prevent the ball from escaping the tether. The knot itself may be used as an indicator that the tether needs replacement, i.e., when the knot begins to fray, the tether is likely to need replacement. It may be desirable, however (for aesthetic or other reasons) to hide the knot and in such case, the ball B may be provided with a recess or depression for receiving the knot. A sleeve 36 of nylon belting or other suitable material is loosely fitted over the tether 32 and serves as a tee, as will be described further below. The other end of the tether 32 is folded over (and crimped & by a ferrule or like fastener) to form a loop, the free end of the cord adjacent the loop being secured within a sleeve 38. The loop is employed to secure one end of the tether 32 to a plurality (two shown in FIGS. 1 and 2) of elastic (rubber) bands 40 which extend between an S-shaped hook 42 and a pin 44 extending parallel to the fasteners 30 between the opposite side walls 24, 26 of the channel, and proximate the rearward end of the channel. Thus, the S-shaped hook 42 provides a coupling between tether 32 and the elastic bands 40. The tether 32 may be constructed of reinforced woven or other suitable material. When the outer woven strands begin to fray, replacement is indicated.

At the forward end of the channel 22, there are located three brass bearings 48, 50 and 52, each of which is mounted on a shaft or stud 54, 56, and 58, respectively. The studs or shafts 54, 56, and 58 are secured between the side walls 24, 26 of the channel by any suitable means. The arrangement is such that the bearings 48, 50 and 52 are freely rotatable. As is apparent from FIG. 4, the channel side walls 24 and 26 are provided with four sets of apertures 60 to permit adjustability with respect to the bearing mounting arrangement as will be described hereinbelow. In addition, the rearward end of the channel is provided with a plurality of sets of apertures 62 which enable the pin 44 to be adjusted forwardly or rearwardly to thereby control the tension of the bands 40.

FIG. 4 illustrates one exemplary embodiment wherein the cord or tether 32 is fed over the first bearing 48, under the second bearing 50, and over the third bearing 52. In the position shown in FIG. 4, however, the tension on the bands has pulled the tether, tee 36 and the ball B rearwardly from the third bearing 52 to a "tee-up" position. When the ball is struck, it will be appreciated that the tether 32 rides over the top of the bearing 52 as will also be described further below.

Returning to FIG. 1, the upper platform 14 is arranged relative to the lower platform 12 so that a tapered slot S in the upper platform is axially aligned with the channel 22. In other words, the ball B and the tee 35 lie on the upper surface of the platform 14 by reason of having been pulled through the slot S at the wider and forward end thereof. The upper platform 14 is also located axially relative to the channel 22 so that after the ball is struck, it will return to a tee-up position substantially as shown in FIG. 1.

The upper platform 14 is adjustable axially relative to the platform 12, by means of fasteners 64 and the plurality of selectable apertures 66 provided at axially and laterally spaced locations on the upper platform 14. Thus, the fasteners 64 may include studs which are fixed within the lower platform 12, and the platform 14 may then be adjusted so that the studs protrude through the selected ones of the apertures 66. The fasteners 64 also include knurled nuts which threadably engage the studs to thereby secure the upper platform 14 to the lower platform 12 in the desired position. This axial adjustment capability is depicted in phantom in FIG. 2. Other, optionally usable fasteners (not shown), may be provided in the lower platform 12 for use with optionally usable apertures (not shown) in the upper platform 14) so that the upper platform 14 can be disassembled from the position shown in FIGS. 1 and 2 and reoriented relative to the lower platform 12 to substantially overlie the latter. This provides a more compact arrangement for storage and/or shipment. Further in this regard, the foot mat 16 may then be wrapped around the aligned upper and lower platforms to even further facilitate shipment and storage.

The target area T on the upper platform 14 may include different selectably usable targets. For example, the target 68 shown in place at the forward end of the upper platform 14 in FIG. 1 may comprise a rubber strip 70 with a foam backing 72, with the strip 70 secured to a support block 74 by means of suitable fasteners 76. The front face of the strip 70 may be divided into sections by vertical lines so that the user may determine where the ball has struck the target relative to a center vertical line. The target strip 70 may be formed of a black rubber material and the ball B may be marked with chalk or other suitable substance and, upon hitting the ball, the latter will strike the target strip 70 and leave a chalk mark on the target strip to thereby indicate a left, right, or straight shot.

An alternative target is shown at 78 consisting essentially of a beanbag portion 80 and a fastener strap 82. This target can be applied over the target 68, or separately secured to the platform 14. As a result of the beanbag type construction, the golf ball B will leave dimples or depressions in the surface of the target 80 which will disappear gradually after several hits.

It will be appreciated that the target may also be divided into segments, each connected electrically to a light so that the area of the target struck by the ball will light up when struck, with manual or automatic re-set.

As earlier indicated, the user will address the ball from the foot mat 16 and strike the ball in the direction indicated by the arrow A. The ball will fly approximately 18 inches and strike the target 68 or 70. The tension created by expansion of the bands 40 immediately returns the ball for the next shot, as explained below. Given the above structural set-up, there are several features and adjustments relating to the apparatus which allow the user to simulate various golf shots and golf conditions, explained in greater detail below.

The tension in the rubber bands 40 can be varied by moving the pin 44 to selected pairs of the apertures 62. By increasing tension, the ball B can be made to return to a tee-up position where the tee or sleeve 36 is drawn back into the narrowest portion of the slot S as shown in FIGS. 1 and 4, with the ball sitting atop the tee. By decreasing tension, the ball B can be returned to the position generally as shown in FIG. 4, but such that the ball B can be pushed rearwardly off the tee as shown in phantom in FIG. 4. Thus, the ball can sit directly on the upper platform 14, to thereby simulate a situation where the ball B lies directly on the ground.

It will also be appreciated that the number and type of rubber or other elastic bands 40 may also be increased to three or four (or more), depending on club selection and the weight of the hit.

To add even further flexibility regarding the lie of the ball, a rubber pad 84 (see FIG. 1) may be placed on the upper platform 14, directly behind the ball B, to thereby simulate a depressed or partially buried lie. Pad 84 is shown to include a plurality of holes 86 connected by slits 88 which enable the pad 84 to "give" (split slightly in lateral directions) when struck by the heel of a golf club, to thereby simulate a "heavy" hit (and also insure greater service life for the pad). It will be appreciated, however, that other suitable pad constructions or devices for simulating a depressed or partially buried lie may be employed.

Another feature of the invention is that the upper platform 14 may be flexed upwardly or downwardly relative to a normal horizontal orientation, as shown in phantom in FIG. 3. It will be appreciated that the platform 14 can be maintained in an upwardly flexed position simply by placing, for example, a foam block (or other suitable object) beneath the platform 14. In the upwardly flexed position, an uphill shot is simulated. In addition, the upwardly flexed position insures that the ball B will not fly over the target 68 when high arc shots are hit (using for example, a seven iron, nine iron, wedge, etc.).

The upper platform 14 may be maintained in a downwardly flexed position by placing a weight on the forward portion of the upper platform 14, adjacent the target area T (or by any other suitable means). In the downwardly flexed position, a downhill lie is simulated for any club, but this orientation also facilitates low trajectory shots, such as a No. 1 driver.

Another feature of the invention relates to the optional arrangements of the tether 32 vis-a-vis the bearings 48, 50 and 52. Depending on the selected arrangement, greater or lesser friction, i.e., braking force, is generated in opposition to the flight of the ball. For example, the arrangement shown in FIG. 5A, where the tether 32 extends below bearings 48 and 50 but above bearing 52, with the bearing 52 one space or hole (as determined by apertures 60) removed from the bearing 50, is best suited for very light shots, since little braking action is achieved.

Figure 5B:
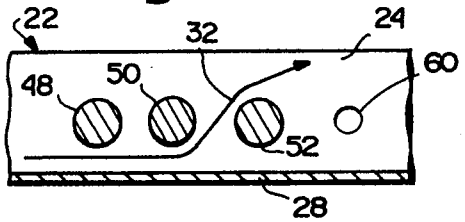
FIGS. 5A through 5D are part section views showing alternative bearing arrangements for the tether to which the ball is attached.

The arrangement shown in FIG. 5B, where tether 32 extends below bearings 48 and 50, but above bearing 52, which has now been moved immediately adjacent bearing 50, generates some additional braking force, but is nevertheless best suited for light shots.

Figure 5D:
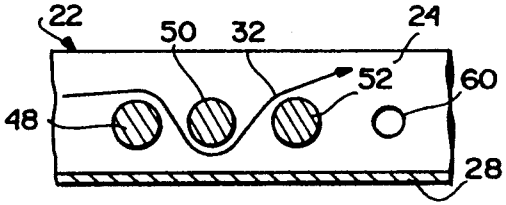
Figure 5A:
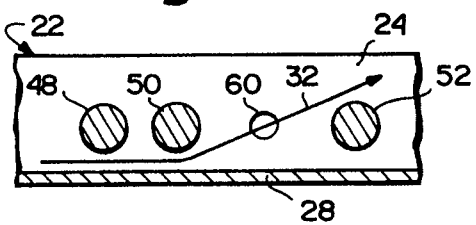
Figure 5C:
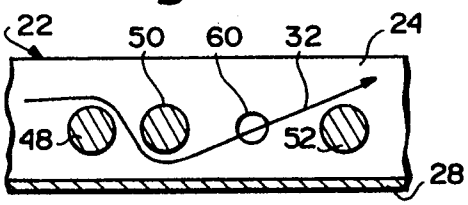

The arrangement shown in FIG. 5C (and FIG. 4), where the tether 32 extends above bearing 48, below bearing 50, and above bearing 52, with the latter one space removed from bearing 50, generates further braking force and is best suited for medium shots.

Finally, the arrangement shown in FIG. 5D, where the tether 32 extends above bearing 48, below bearing 50, and above bearing 52, with the latter moved immediately adjacent the bearing 50, generates the most friction and is therefore best suited for heavy or hard shots.

Generally, as the distance between the individual bearings decreases, the amount of braking friction increases, and vice versa. Thus, the bearing arrangement can be altered to suit particular requirements. In addition, it will be appreciated that this distance is also dependent on the diameter of the tether 32. The combination of these two factors determines the overall braking characteristics. It should also be noted here that the sleeve 38 creates an additional braking force in the forward or hitting direction, as well as in the rearward or return direction. This is achieved by reason of the fact that the sleeve 38 will slide along the underside of platform 14 after the ball B has been struck, thus generating sliding friction which resists forward movement of the tether and extension of the elastic bands 40. In the return direction, on the other hand, the sleeve 38 and bearings 48, 50, 52 resist the contraction forces of the bands 40, thus achieving a controlled return of the ball after the target 68 is struck. The combined braking action is significant in that the ball speed is slowed and the arc of the flight quickly reduced, so that the ball will strike the target 68.

Still another feature of the invention relates to the lateral trajectory of the ball B. As already indicated, the target 68 is delineated so as to indicate a right or a left in addition to a straight shot. In accordance with the invention, the spin direction of the ball may also be observed by the direction of twisting of the elastic bands 40. This is made possible if ball B is fixed to the tether 32 so that rotation of the ball will cause non-corresponding rotation of the tether, and hence the bands 40 via S-hook 38. This twisted condition is illustrated in FIG. 4. Thus, if the bands 40 have been twisted to the right, indicating counterclockwise rotation of the ball, it will be further apparent that the shot hooked to the left. On the other hand, if the bands are twisted to the left, it will indicate that the ball rotated in a clockwise direction thus confirming that the shot sliced to the right. If desired, the bands can be pre-twisted (or untwisted) and further evaluation of the bands after the ball has been struck will provide another indication of the direction of rotation of the ball during flight.

The ball, on impact, lays over because of the tether and this causes non-corresponding rotation. Once the user has become familiar with the characteristics of the device, he or she can accurately determine the flight characteristics of each shot.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A golf practice apparatus comprising:

at least one platform having a tee area and a target area located forwardly of the tee area; a golf ball arranged at the area above said platform for striking towards the target area, said golf ball having one end of a tether attached thereto, said tether extending through a slot in said platform, with the other end of the tether being secured to elastic bands anchored at a location rearwardly of the tee area; and a plurality of rotatable, axially spaced bearings located in said tee area below said platform, and arranged so that said tether engages at least two of said plurality of bearings.

2. The golf practice apparatus of claim 1 wherein said plurality of bearings comprises three bearings, and wherein said tether extends below first and second bearings and above a third bearing.

3. The golf practice apparatus of claim 1 wherein said plurality of bearings comprises three bearings and said tether extends above a first bearing, below a second bearing and above a third bearing.

4. The golf practice apparatus of claim 3 wherein said third bearing is spaced from said second bearing a distance greater than a distance between said first and second bearings.

5. The golf practice apparatus of claim 2 wherein said third bearing is spaced from said second bearing a distance greater than a distance between said first and second bearings.

6. The golf practice apparatus of claim 3 wherein said first, second and third bearings are equally spaced in an axial direction of said tether.

7. The golf practice apparatus of claim 2 wherein said first, second and third bearings are equally spaced in an axial direction of said tether.

8. The golf practice apparatus of claim 1 wherein said elastic band comprises a plurality of rubber bands.

9. The golf practice apparatus of claim 8 wherein said plurality of rubber bands extend between said tether and an anchor located rearwardly of the tee area.

10. The golf practice apparatus of claim 9 wherein said anchor is adjustable linearly.

11. The golf practice apparatus of claim 1, wherein a target is mounted on said platform in said target area, said target including means for permitting direction of flight of said golf ball to be indicated.

12. The golf practice apparatus of claim 1 wherein said at least one platform is supported on a second lower platform, said second lower platform supporting said other end of said tether and said plurality of rotatable, axially spaced bearings.

13. The golf practice apparatus of claim 12 wherein said lower platform mounts a substantially U-shaped channel, said other end of said tether and said plurality of rotatable, axially spaced bearings being supported in said channel in substantially axial alignment with said slot in said at least one platform.

14. The golf practice apparatus of claim 1 wherein a sleeve is fixed to said tether adjacent a coupling of said tether to said elastic bands.

15. A golf practice apparatus comprising:

at least one platform having a tee area and a target area located forwardly of the tee area; a golf ball arranged at the area above said platform for striking towards the target area, said golf ball having one end of a tether attached thereto, said tether extending through a slot in said platform, with the other end of the tether being secured to elastic means anchored below said platform at a location rearwardly of the tee area; the tether having a sleeve attached thereto which is adapted to engage an undersurface of the platform, and thereby generate friction between said platform and said sleeve when the ball is struck.

16. The golf practice apparatus of claim 15 wherein said elastic means comprises a plurality of rubber bands.

17. The golf practice apparatus of claim 15 wherein said plurality of rubber bands extend between said tether and a transverse pin.

18. The golf apparatus of claim 15 wherein said transverse pin is adjustable linearly.

19. The golf practice apparatus of claim 15 and further including a plurality of rotatable, axially spaced bearings located in said tee area below said platform, and arranged so that said tether engages at least two of said plurality of bearings.

20. The golf practice apparatus of claim 19 wherein said plurality of bearings comprises three bearings, and wherein said tether extends below first and second bearings and above a third bearing.

21. The golf practice apparatus of claim 19 wherein said plurality of bearings comprises three bearings and said tether extends above a first bearing, below a second bearing and above a third bearing.

22. The golf practice apparatus of claim 19 wherein said third bearing is spaced from said second bearing a distance greater than a distance between said first and second bearings.

23. The golf practice apparatus of claim 19 wherein said third bearing is spaced from said second bearing a distance greater than a distance between said first and second bearings.

24. The golf practice apparatus of claim 19 wherein said first, second and third bearings are equally spaced in an axial direction of said tether.

25. The golf practice apparatus of claim 19 wherein said first, second and third bearings are equally spaced in an axial direction of said tether.

26. A golf practice apparatus comprising:

an upper platform having a tee and a target located forwardly of the tee; a golf ball arranged at the tee above said platform for striking towards the target area, said golf ball having one end of a tether attached thereto, said tether extending through a slot in said upper platform, with the other end of the tether being secured to elastic bands anchored to a lower platform at a location rearwardly of the tee area; and a plurality of bearings located in said tee area and supported on said lower platform, and arranged so that said tether engages at least two of said plurality of bearings; the tether having a sleeve attached thereto which is adapted to engage an undersurface of said upper platform, and thereby generate friction between said upper platform and said sleeve when the ball is struck.

27. The golf practice apparatus of claim 26 wherein the upper and lower platforms are in partially overlying relationship, such that said upper platform extends beyond said lower platform in a forward direction and wherein said tether, plurality of bearings and elastic means are axially aligned with said slot in said upper platform.

28. The golf practice apparatus of claim 27 wherein a forward end of said upper platform, including said target area is adjustable in up and down directions.

29. The golf practice apparatus of claim 26 wherein a foot pad extends perpendicularly from said upper and lower platforms.

30. The golf practice apparatus of claim 26 wherein said plurality of bearings comprises three axially adjustable, rotatable bearings.

31. The golf practice apparatus of claim 26 wherein tension in said elastic bands is adjustable.

32. The golf practice apparatus of claim 26 wherein said tee comprises a sleeve loosely mounted on said tether, between said ball and said slot.

33. The golf practice apparatus of claim 26 wherein said target is spaced from said tee a distance of about 18 inches.

34. The golf practice apparatus of claim 15 wherein said elastic bands indicate hook or slice or straight shots.

* * * * *